US007068245B2

(12) United States Patent
Nagao et al.

(10) Patent No.: US 7,068,245 B2
(45) Date of Patent: Jun. 27, 2006

(54) PLASMA DISPLAY APPARATUS

(75) Inventors: Nobuaki Nagao, Osaka (JP); Junpei Hashiguchi, Osaka (JP); Katsutoshi Shindo, Osaka (JP); Toshikazu Wakabayashi, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 344 days.

(21) Appl. No.: 10/603,040

(22) Filed: Jun. 24, 2003

(65) Prior Publication Data

US 2004/0263433 A1 Dec. 30, 2004

(51) Int. Cl.
*G09G 3/28* (2006.01)

(52) U.S. Cl. ..... 345/60; 345/67; 345/68

(58) Field of Classification Search ..... 345/60–72, 345/204–215; 315/169.1–169.4
See application file for complete search history.

(56) References Cited

U.S. PATENT DOCUMENTS

| | | | | |
|---|---|---|---|---|
| 6,906,690 | B1 * | 6/2005 | Lim | 345/60 |
| 2003/0057854 | A1 * | 3/2003 | Roh | 315/169.3 |
| 2005/0057451 | A1 * | 3/2005 | Lim | 345/60 |

* cited by examiner

*Primary Examiner*—Vijay Shankar
(74) *Attorney, Agent, or Firm*—RatnerPrestia

(57) ABSTRACT

A plasma display apparatus has a waveform of a driving voltage supplied from a driver. The waveform has a sustaining period when a sustaining pulse is alternately applied to scanning electrodes and sustain electrodes for keeping discharge. Besides, the waveform has an erasing period when a ramp voltage pulse whose polarity differs from that of a sustaining pulse is applied to an electrode, which differs from an electrode where a last pulse of the sustaining pulse is applied. As a result, false discharge is prevented, and a stable image can be displayed.

11 Claims, 8 Drawing Sheets

FIG. 7

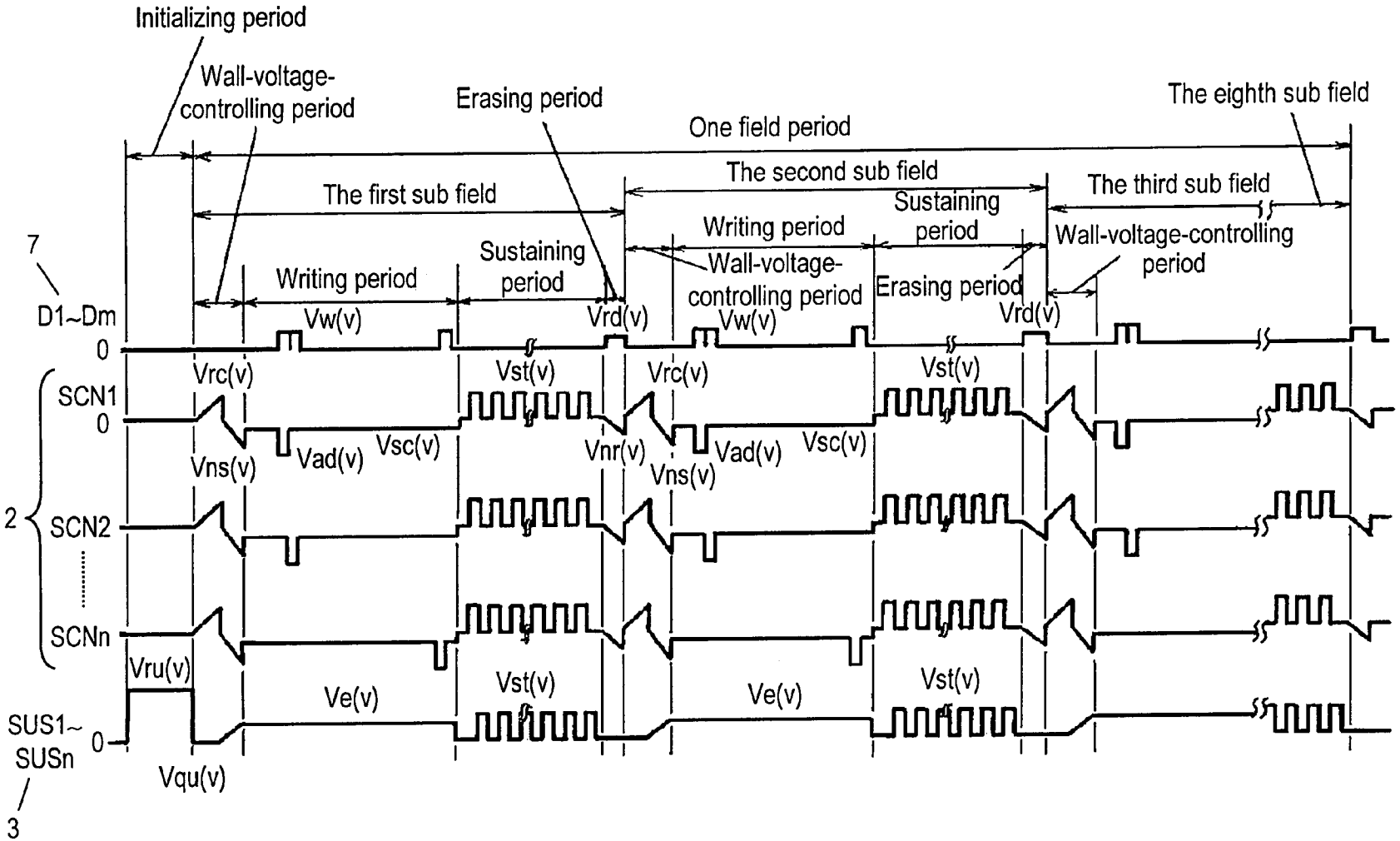
Initializing period
Wall-voltage-controlling period
Erasing period
One field period
The first sub field
The second sub field
The third sub field
The eighth sub field
Writing period
Sustaining period
Wall-voltage-controlling period
Erasing period
Vrc(v)
Vw(v)
Vrd(v)
Vst(v)
Vns(v)
Vnr(v)
Vad(v)
Vsc(v)
Vrd(v)
Vst(v)
Vrc(v)
Vw(v)
Vrd(v)
Vst(v)
Vns(v)
Vad(v)
Vsc(v)
Vst(v)
Vrc(v)
Vrd(v)
Vst(v)
Vrc(v)
Vrd(v)
Vst(v)
Vrc(v)
Vrd(v)
Vst(v)
Vrc(v)
Vrd(v)
Vst(v)
Vrc(v)
Vrd(v)
Vst(v)
Vrc(v)
Vrd(v)
Vst(v)
Vrc(v)
Vrd(v)
Vst(v)
Vrc(v)
Vrd(v)
Vst(v)
Vrc(v)
Vrd(v)
Vst(v)
Vrc(v)
Vrd(v)
Vst(v)
Vns(v)
Vad(v)
Vsc(v)
Vns(v)
Vad(v)
Vsc(v)
Vns(v)
Vad(v)
Vsc

PLASMA DISPLAY APPARATUS

BACKGROUND OF THE INVENTION

1. Field of the Invention

The present invention relates to display apparatus using a plasma display panel (PDP) known as a thin and light display having a larger screen.

2. Background Art

In a plasma display panel, phosphor is excited by ultraviolet rays, which are generated by gas discharge, and emits light, thereby making a color display.

The plasma display apparatuses are classified into two driving systems, i.e., an AC type and a DC type, and classified into two electric discharge systems, i.e., a surface discharge type and an opposed discharge type. A three-electrodes type and surface discharge type plasma display apparatus becomes a mainstream, because of high resolution, a large display and easy manufacturing for simplicity of its structure. FIG. 8 shows a common structure of a panel section of the plasma display apparatus.

A first board includes scanning electrode 2 and sustain electrode 3 which are disposed at an interval of MG (hereinafter referred to as a "main discharge gap MG") on transparent and insulating substrate 1, e.g., a glass, to form a first board. A plurality of scanning electrodes 2 and sustain electrodes 3 are disposed at intervals of IPG (hereinafter referred to as an "inter pixel gap IPG") in pairs. Dielectric layer 4 and protective film 5 are formed in a manner to cover scanning electrode 2 and sustain electrode 3. A second board includes a plurality of data electrodes 7 which are disposed on insulating substrate 6, e.g., a glass, and dielectric layer 8 covers data electrodes 7. On dielectric layer 8, barrier rib 9 is disposed between data electrodes 7, and parallel thereto. Phosphor 10 is formed on a surface of dielectric layer 8 and sides of barrier rib 9. Substrate 1 and substrate 6 confront each other in a manner that scanning electrode 2 and sustain electrode 3 cross data electrode 7 at right angles, so that a section where a pair of scanning electrode 2 and sustain electrode 3 crosses data electrode 7 becomes discharge cell 11. Xenon gas and at least one of helium, neon and argon gas are sealed as discharge gas in discharge cell 11.

FIG. 9 illustrates a schematic view of a driver, which outputs a driving voltage for driving the panel section shown in FIG. 8, and a wire connecting state for electrodes of the panel section. Arrangement of the electrodes of the panel section constitutes an m by n (m×n) matrix. Data electrodes 7 with m columns are arrayed in a column direction for addressing, and scanning electrodes 2 and sustain electrodes 3 with n rows are arrayed in pairs and in a row direction for keeping discharge.

The driver includes data-writing-driving circuit 12, scanning-electrode-driving circuit 13, initializing circuit 14 and sustain-electrode-driving circuit 15. Data-writing-driving circuit 12 is a circuit for outputting the driving voltage to data electrode 7, and is coupled to data electrodes 7 with m output terminals. Scanning-electrode-driving circuit 13 is a circuit for outputting the driving voltage to scanning electrode 2, and is coupled to scanning electrodes 2 with n output terminals. Sustain-electrode-driving circuit 15 is a circuit for outputting the driving voltage to sustain electrode 3, and is coupled to sustain electrode 3 in common. Initializing circuit 14 is a circuit for executing initializing action, namely, driving action for storing initial charge to each electrode, which has no charge before energization.

However, in the plasma display apparatus, which has the panel section and the driver, discussed above, when a discharge-cell pitch is reduced for high resolution, false discharge tends to be generated in Y direction of the panel section shown in FIG. 8.

The reason of the mechanism is considered as follows. After the last sustaining discharge is applied, for example, a wall voltage of a surface of protective film 5 on scanning electrode SCNi changes from negative to positive. This state is achieved by positive ions which reach the surface of protective film 5. However, mobility of positive ions (referred to as "μion") is much slower than mobility of electrons (referred to as "μe"). Therefore, for example, the wall voltage near main discharge gap MG is easily changed because positive ions do not need to move a long distance. However, positive ions have to move a long distance at an outside of scanning electrode SCNi, i.e., near inter pixel gap IPG, whereby probability that positive ions do not reach the surface of protective film 5 becomes high. As a result, negative electric charges 16 are not neutralized and remain at the outside of scanning electrode SCNi, i.e., near inter pixel gap IPG. FIG. 10A shows the state discussed above and a sectional view of FIG. 8 taken along the line 10A—10A. In this drawing, the reference mark "+" or "−" shows an electric charge, however, the drawing shows only a concept, and does not show the actual number of electric charges.

The following operations are executed with unnecessary negative electric charge 16 kept near inter pixel gap IPG. In this state, scanning pulse voltage Vad is applied to scanning electrode SCNi, and writing pulse voltage Vw is applied to data electrode Dj by a writing operation in a writing period. At that time, as shown in FIG. 10B, discharge 17 is generated between data electrode Dj and unnecessary negative electric charge 16 near inter pixel gap IPG, so that large amounts of priming-effect particles, e.g., metastable atom or ion, are generated according to discharge 17. Priming-effect particles tend to flow into inter pixel cells because a place, where discharge 17 is generated, is near inter pixel gap IPG. This phenomenon remarkably occurs in a case where a pitch of discharge cell 11 is narrow. As shown in FIG. 8, there is no barrier such as barrier rib 9, which prevents discharge in X direction, in Y direction, so that priming-effect particles mainly flow into inter pixel cells in Y direction, and change a wall voltage of discharge cell 11. As a result, false discharge, which causes a writing-error or -reject, occurs in Y direction.

SUMMARY OF THE INVENTION

A plasma display apparatus includes the following elements:

(A) a panel section including:
  (A-1) a first board having a plurality of scanning electrodes and sustain electrodes in pairs, and
  (A-2) a second board having data electrodes which cross the scanning electrodes and the sustain electrodes, and faced the first board, (B) a driver for outputting a driving voltage for driving the panel section.

In addition, the plasma display apparatus includes the following periods:

(a) a sustaining period when a sustaining pulse is alternately applied to the scanning electrodes and the sustain electrodes for keeping discharge, and (b) an erasing period when a ramp voltage pulse whose polarity differs from polarity of the sustaining pulse is applied to an electrode, which differs from an electrode where the last pulse of the sustaining pulse is applied.

BRIEF DESCRIPTION OF THE DRAWINGS

FIG. 7 shows a timing chart of a driving voltage supplied from a driver of a plasma display apparatus in accordance with another exemplary embodiment of the present invention.

DETAILED DESCRIPTION OF THE PREFERRED INVENTION

FIRST EMBODIMENT

Figure 8:
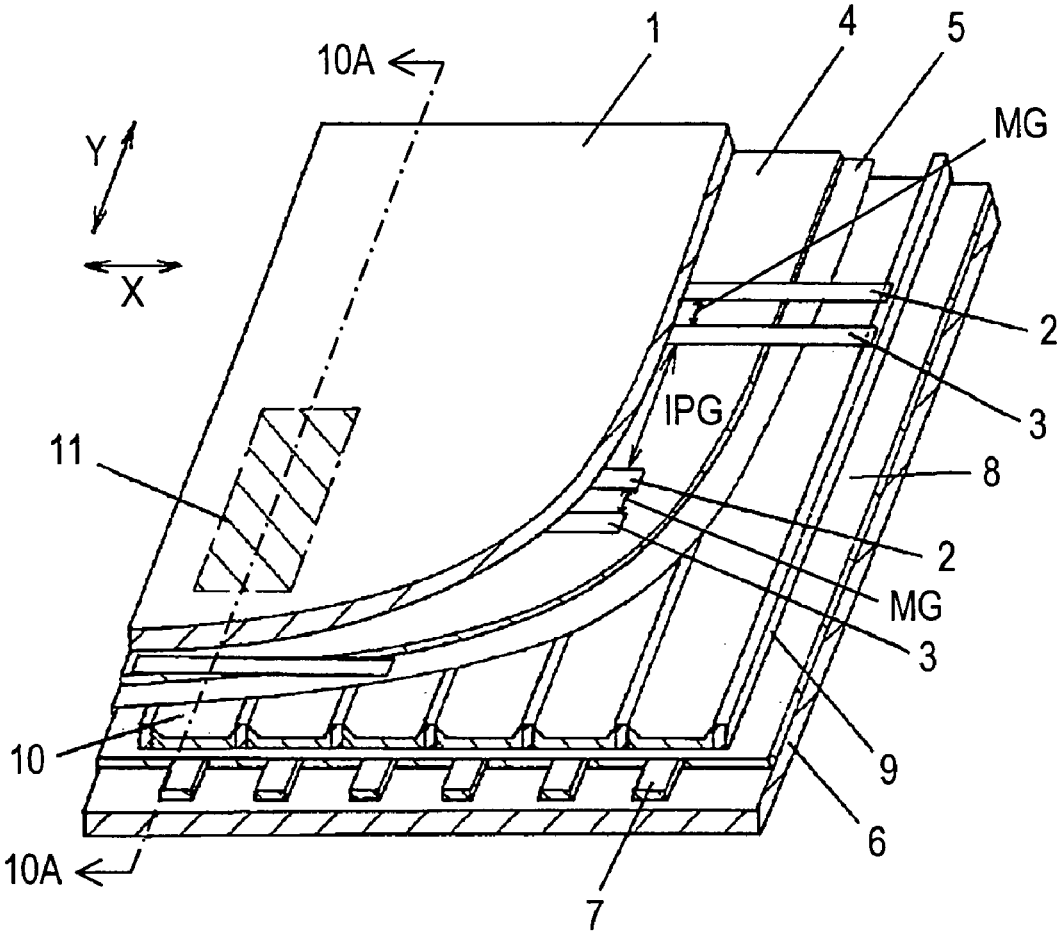
FIG. 8 PRIOR ART
FIG. 8 shows a perspective sectional view of a structure of a panel section of a conventional plasma display apparatus.
Figure 9:
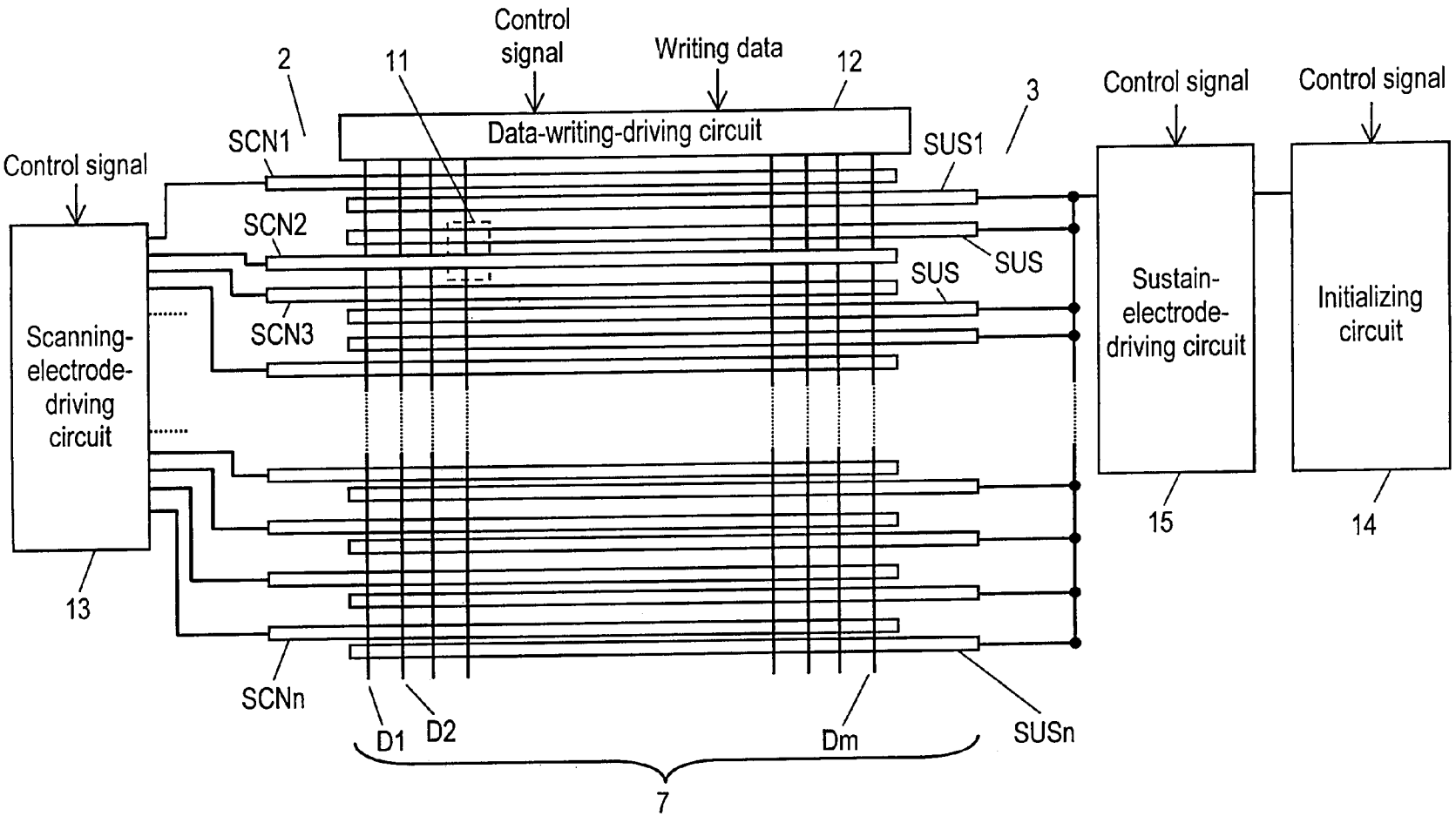
FIG. 9 PRIOR ART
FIG. 9 shows a schematic view of a driver and a wire connecting state for electrodes of the panel section of the conventional plasma display apparatus.
Figure 10A:
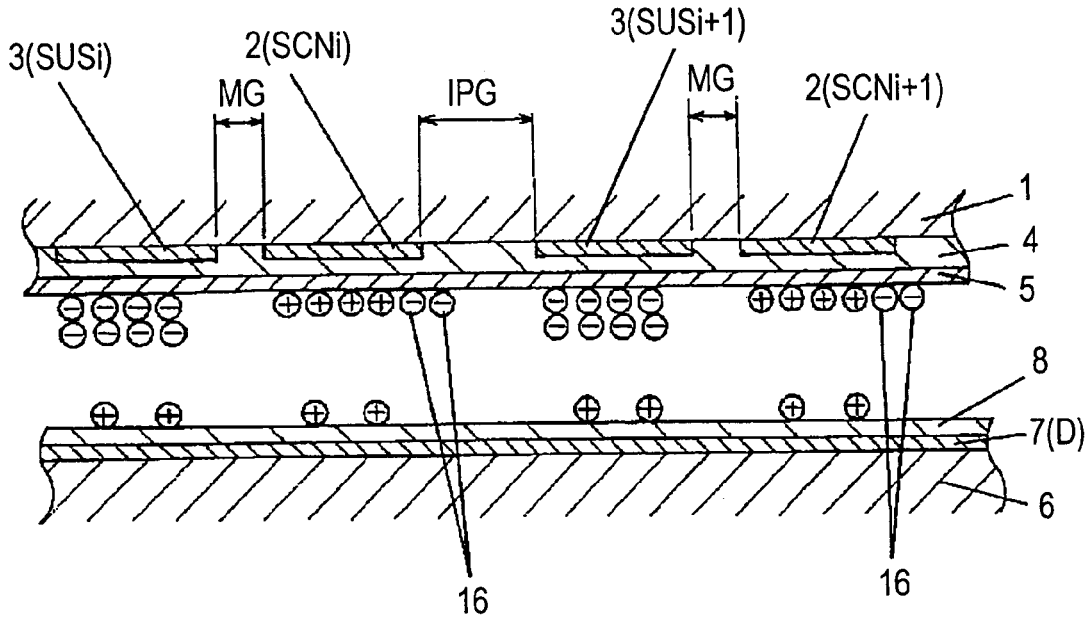
FIG. 10A PRIOR ART
FIGS. 10A and 10B show charge states in the panel section of the conventional plasma display apparatus.
Figure 10B:
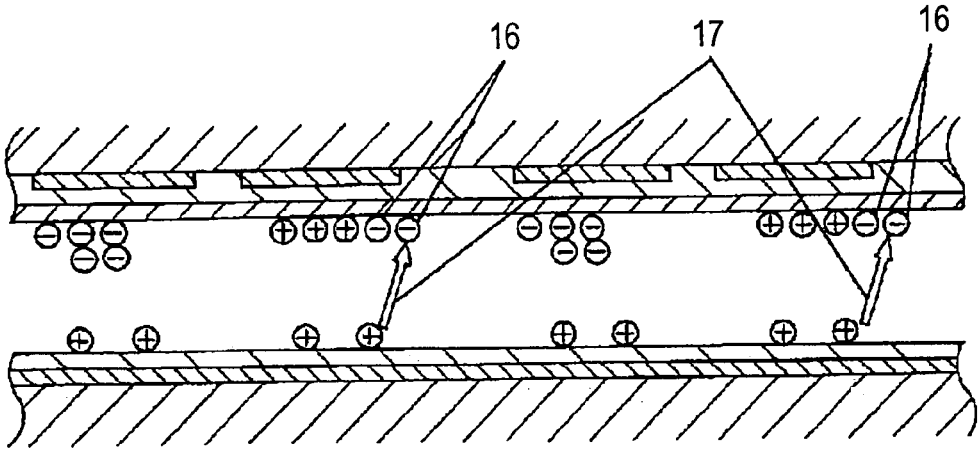
FIG. 10B PRIOR ART

The first exemplary embodiment is described hereinafter with reference to the accompanying drawings. A panel section of the first embodiment is the same as that shown in FIG. 8. Besides, a schematic view of a driver, which outputs a driving voltage for driving the panel section, and a wire connecting state for electrodes of the panel section are the same as that shown in FIG. 9. Therefore, the descriptions of those elements are omitted here.

Figure 1:
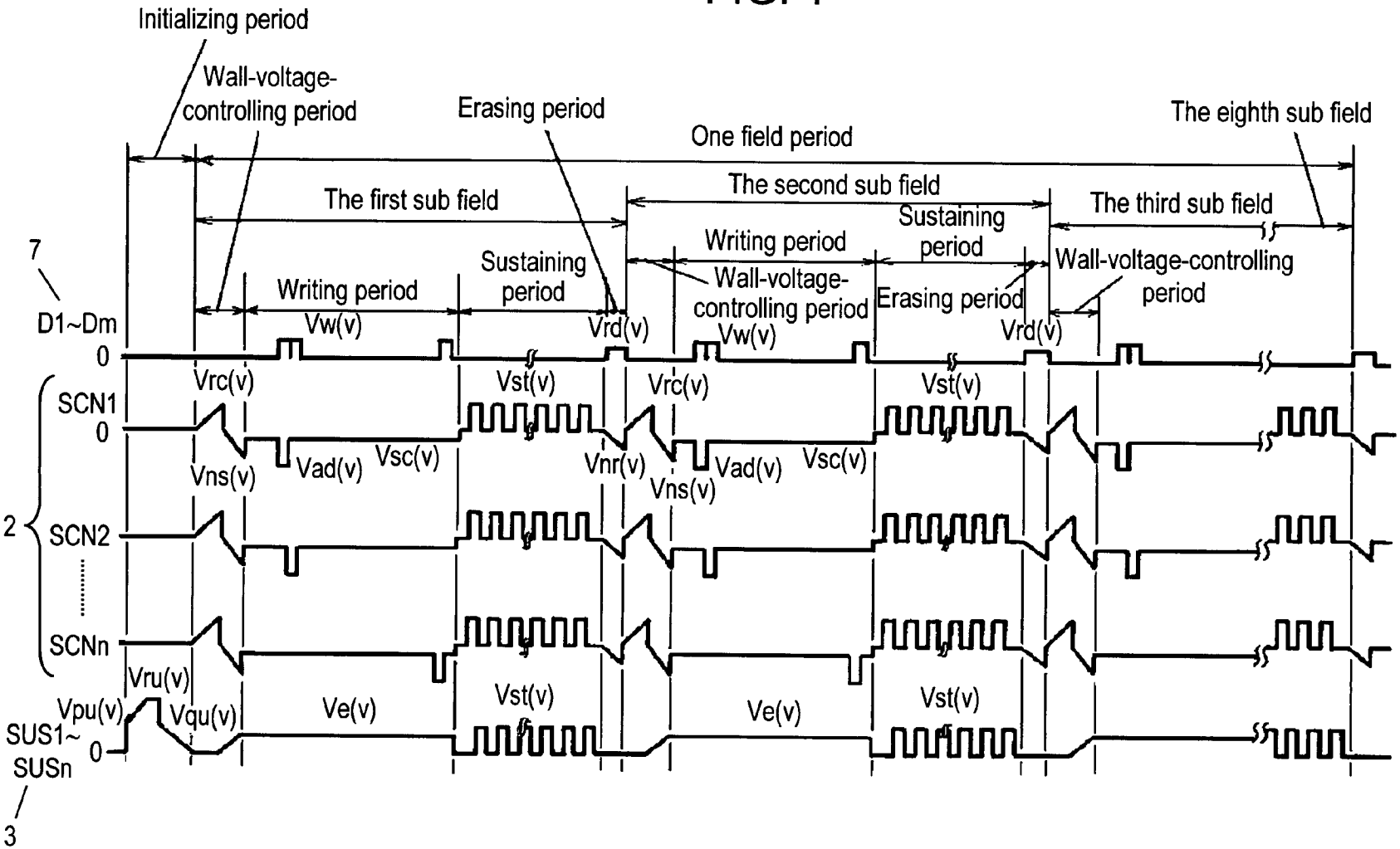
FIG. 1 shows a timing chart of a driving voltage supplied from a driver of a plasma display apparatus in accordance with a first exemplary embodiment of the present invention.

FIG. 1 shows a waveform of a driving voltage supplied from the driver for driving the panel section of a plasma display apparatus in the first embodiment. An initializing period and one field period after that are shown in FIG. 1. In the initializing period, initial charges are stored to each electrode, which has no charge before energization.

One screen is displayed in the one field period and, for example, the one field period consists of a plurality of sub fields, (e.g., the first sub field to the eighth sub field). One sub field consists of a wall-voltage-controlling period, a writing period, a sustaining period and an erasing period. Operations in these periods are described hereinafter.

First, an operation in the initializing period is described hereinafter. In the initializing period, voltages of all data electrodes D1–Dm and all scanning electrodes SCN1–SCNn are kept 0 V. Voltages of all sustain electrodes SUS1–SUSn increase rapidly from 0 to Vpu, where Vpu is a voltage not more than a discharge-starting voltage for all scanning electrodes SCN1–SCNn. Then, a driving voltage, which has a positive polarity and slowly increases from Vpu to Vru, is applied to all sustain electrodes SUS1–SUSn, where Vru is a voltage more than the discharge-starting voltage.

In the slow increasing process, at all discharge cells 11, the first faint initializing-discharge is generated from all sustain electrodes SUS1–SUSn to all data electrodes D1–Dm and all scanning electrodes SCN1–SCNn. Therefore, negative wall voltages are stored on a surface of protective film 5 on sustain electrodes SUS1–SUSn, and positive wall voltages are stored on a surface of phosphor 10 on data electrodes D1–Dm and a surface of protective film 5 on scanning electrodes SCN1–SCNn. Then, voltages of all sustain electrodes SUS1–SUSn slowly decrease to 0 V in a manner that discharge is not generated between respective electrodes. As discussed above, the initializing operation in the initializing period is finished.

Second, an operation in the wall-voltage-controlling period is described hereinafter. In the wall-voltage-controlling period, 0 V is applied to all sustain electrodes SUS1–SUSn and all data electrodes D1–Dm. A driving voltage, which has a positive polarity and slowly increases from 0 to Vrc, is applied to all scanning electrodes SCN1–SCNn.

In the slow increasing process, faint discharge is generated at all discharge cells 11, where all sustain electrodes SUS1–SUSn show negative, and all scanning electrodes SCN1–SCNn show positive. At that time, positive wall voltages on the surface of protective film 5 on all scanning electrodes SCN1–SCNn and negative wall voltages on the surface of protective film 5 on sustain electrodes SUS1–SUSn are adjusted to wall voltages. The adjusted wall voltages are suitable voltages for a writing operation in the writing period after the wall-voltage-controlling period.

Furthermore, 0 V is applied to all scanning electrodes SCN1–SCNn, and then a driving voltage, which slowly decreases to Vns, is applied thereto. At the same time, a driving voltage, which slowly increases from 0 to Ve, is applied to all sustain electrodes SUS1–SUSn. In the application of these driving voltages, faint discharge is generated, where all sustain electrodes SUS1–SUSn and all data electrodes D1–Dm show positive, and all scanning electrodes SCN1–SCNn show negative. Positive wall voltages on the surface of phosphor 10 on data electrodes D1–Dm, negative wall voltages on the surface of protective film 5 on all sustain electrodes SUS1–SUSn and positive wall voltages on the surface of protective film 5 on all scanning electrodes SCN1–SCNn are adjusted to wall voltages. The adjusted wall voltages are suitable voltages for the writing operation in the writing period after the wall-voltage-controlling period. As discussed above, the wall-voltage-controlling period is finished.

Third, the writing operation in the writing period is described hereinafter. In the writing period, Vsc is applied to all scanning electrodes SCN1–SCNn, and Ve is continuously applied to all sustain electrodes SUS1–SUSn. Among data electrodes D1–Dm, a writing pulse voltage having positive voltage Vw is applied to data electrode Dj (the reference mark j denotes 1–m of an integer) corresponding to discharge cell 11, which should be displayed as the first row. At the same time, negative voltage Vad is applied to scanning electrode SCN1 of the first row.

At an intersection (referred to as "the first intersection") of data electrode Dj and scanning electrode SCN1, electric potential between the surface of phosphor 10 and the surface of protective film 5 on scanning electrode SCN1 is calculated hereinafter.

Add the positive wall voltage on the surface of phosphor 10 on data electrode Dj to voltage Vw of a data waveform, and subtract the negative wall voltage on the surface of protective film 5 on scanning electrode SCN1 therefrom. In other words, add absolute values of these voltage values.

As a result, at the first intersection, writing discharge is generated between data electrode Dj and scanning electrode SCN1. The writing discharge mentioned above causes another writing discharge, which is generated between sustain electrode SUS1 and scanning electrode SCN1 at the first intersection. Thus, a positive wall voltage is stored on the surface of protective film 5 on scanning electrode SCN1 at the first intersection, and a negative wall voltage is stored on the surface of protective film 5 on sustain electrode SUS1 at the first intersection.

The same operation is continuously executed until n row, so that the writing operation in the writing period is finished.

Then, an operation in the sustaining period is described hereinafter. In the sustaining period, sustaining pulse Vst is alternately applied to all scanning electrodes SCN1–SCNn and all sustain electrodes SUS1–SUSn, so that sustaining-discharge is continuously executed at discharge cell 11, where the writing discharge is generated. Visible light from phosphor 10 excited by ultraviolet rays, which is caused by the sustaining-discharge, is used for display.

Conditions of wall voltages of scanning electrode SCNi and sustain electrode SUSi at discharge cell 11, where sustaining-discharge is continuously executed, are described hereinafter. When Vst is applied to scanning electrode SCNi and 0 V is applied to sustain electrode SUSi, discharge is generated from scanning electrode SCNi to sustain electrode SUSi. Accordingly, positive ions move from scanning electrode SCNi to sustain electrode SUSi, and electrons move from sustain electrode SUSi to scanning electrode SCNi. As a result, a wall voltage of the surface of protective film 5 on sustain electrode SUSi becomes positive, and a wall voltage of the surface of protective film 5 on scanning electrode SCNi becomes negative.

After that, applied voltage of sustaining pulse Vst is alternated, so that 0 V is applied to scanning electrode SCNi and Vst is applied to sustain electrode SUSi. Thus, discharge is generated from sustain electrode SUSi to scanning electrode SCNi, and positive ions and electrons move. As a result, the wall voltage of the surface of protective film 5 on sustain electrode SUSi changes from positive to negative, and the wall voltage of the surface of protective film 5 on scanning electrode SCNi changes from negative to positive. After the operations discussed above are repeated, the sustaining-discharge is finished in a state where Vst is applied to sustain electrode SUSi and 0 V is applied to scanning electrode SCNi. At that time, the wall voltage of the surface of protective film 5 on sustain electrode SUSi changes from positive to negative, and the wall voltage of the surface of protective film 5 on scanning electrode SCNi changes from negative to positive. The sustaining period is finished in the condition mentioned above.

Figure 2:
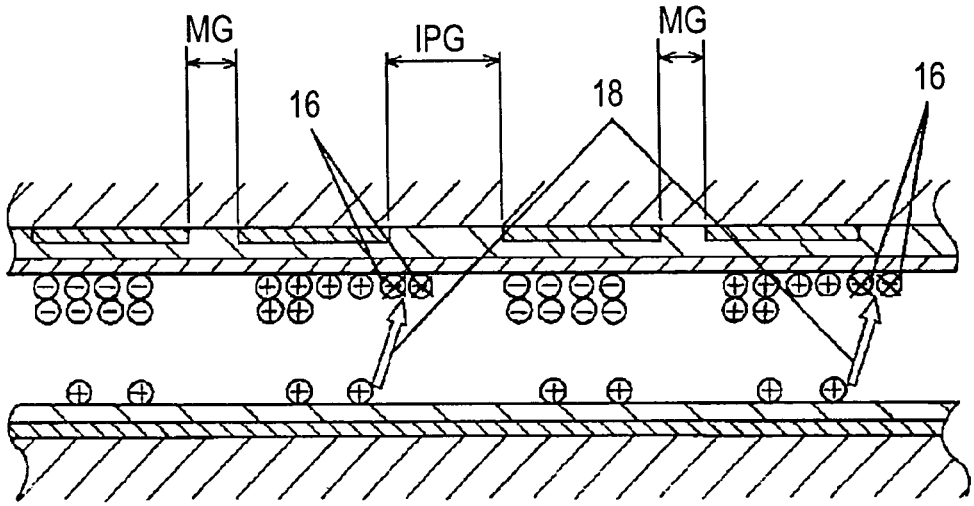
FIG. 2 shows a charge state in a panel section of the plasma display apparatus in accordance with the first exemplary embodiment of the present invention.

Next, an operation in the erasing period is described hereinafter. In the erasing period, data electrode Dj is kept Vrd, and sustain electrode SUSi is kept 0 V. In that condition, a ramp voltage pulse, which slowly decreases to Vnr, is applied to scanning electrode SCNi. While the ramp voltage pulse decreases, faint discharge 18 is generated as shown in FIG. 2, where data electrode Dj shows positive and scanning electrode SCNi shows negative. Unnecessary negative electric charges 16 on protective film 5 of scanning electrode SCNi are erased, so that false discharge can be restrained. FIG. 2 shows a sectional view of FIG. 8 taken along the line 10A—10A. As discussed above, the erasing operation in the erasing period is finished.

The operation in the sub field period, which starts from the wall-voltage-controlling period, is repeated, thereby making one field period and displaying an image.

As discussed above, in this invention, the waveform has an erasing period when a ramp voltage pulse whose polarity differs from that of the sustaining pulse is applied to an electrode, which differs from an electrode where the last pulse of the sustaining pulse is applied. Thus, false discharge can be restrained. As a result, even when a discharge-cell structure of a plasma display apparatus becomes high resolution, a stable image can be displayed.

In this embodiment, if a scanning electrode is referred to as "A" and a sustain electrode is referred to as "B", arrangement of these electrodes on substrate 1 denotes "A" "B" "A" "B". However, the different arrangement can provide the same effect. For example, the same kinds of electrodes can be arranged side by side at adjacent cells, namely, arrangement of "A" "B" "B" "A" can provide the same effect. When the number of discharge cells increases in high resolution, electrostatic capacity between electrodes at a panel section increases, and power loss increases in the arrangement of "A" "B" "A" "B". However, in the arrangement of "A" "B" "B" "A", electrostatic capacity between adjacent cells decreases, and generation of power loss is prevented. Therefore, power consumption of the plasma display apparatus can be restrained.

In addition, when minimum voltage Vnr of the ramp voltage pulse in the erasing period, has the following relation, this invention becomes more effective.

$$-(Vf1-60) \leqq Vnr \leqq -30 \quad \text{(V of units)}$$

where Vf1 shows a discharge-starting voltage between data electrode Dj and scanning electrode SCNi.

SECOND EMBODIMENT

The second exemplary embodiment is described hereinafter with reference to the accompanying drawings. A panel section of the second embodiment is the same as that shown in FIG. 8. Besides, a schematic view of a driver, which outputs a driving voltage for driving the panel section, and a wire connecting state for electrodes of the panel section are the same as that shown in FIG. 9. Therefore, the descriptions of those elements are omitted here, and the only different points of the second embodiment are described hereinafter with reference to FIG. 3.

Figure 3:
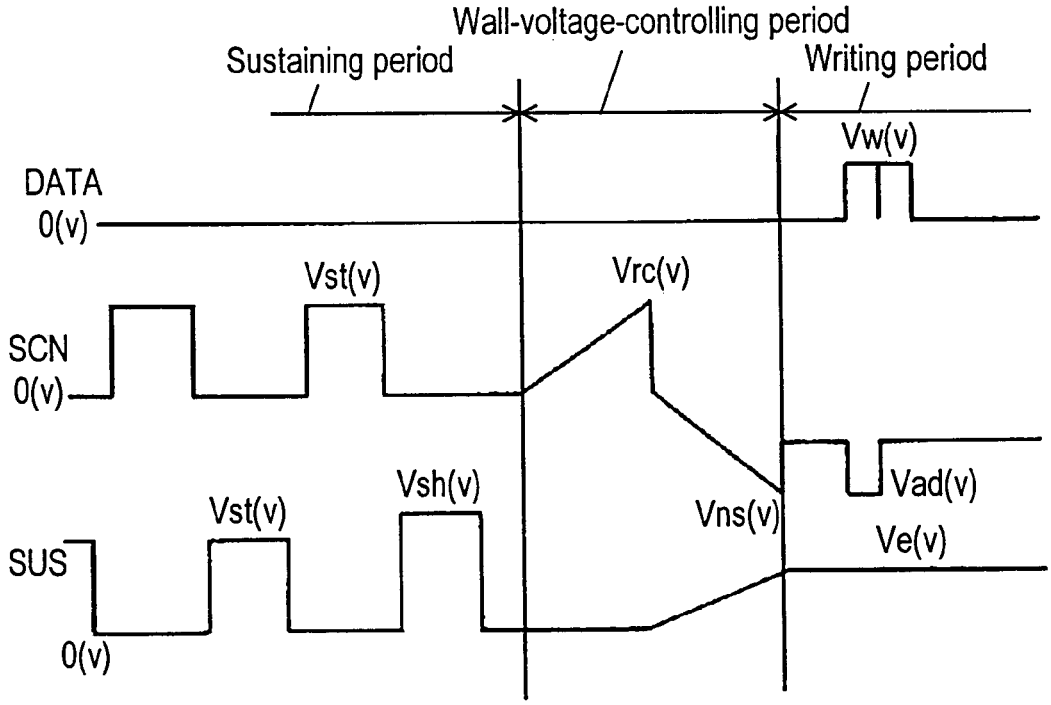
FIG. 3 shows a timing chart of a driving voltage supplied from a driver of a plasma display apparatus in accordance with a second exemplary embodiment of the present invention.

FIG. 3 shows a waveform of a driving voltage supplied from the driver for driving the panel section of a plasma display apparatus in the second embodiment. A sustaining period, a wall-voltage-controlling period and a writing period are shown in FIG. 3.

In the second embodiment, peak voltage Vsh of the last pulse of a sustaining pulse in the sustaining period has the following relation for peak voltage Vst of the sustaining pulse before the last pulse and discharge-starting voltage Vf2, which differs from a conventional plasma display apparatus.

$$Vst \leqq Vsh < Vf2$$

The effect of this relation is considered as follows. Peak voltage Vsh of the last pulse of the sustaining pulse is larger than peak voltage Vst of the sustaining pulse before the last pulse, so that electrical attracting force for positive ions becomes greater at the last sustaining-discharge in the sustaining period. Therefore, positive ions can reach an outside of scanning electrode SCNi, i.e., near inter pixel gap IPG, where a long moving distance is required for positive ions. As a result, after the last sustaining discharge is applied, a wall voltage of a surface of protective film 5 on scanning electrode SCNi sufficiently changes from negative to positive. Thus, unnecessary negative electric charge does not remain, and false discharge is not generated.

As discussed above, peak voltage Vsh of the last pulse of the sustaining pulse has the following relation for peak voltage Vst of the sustaining pulse before the last pulse and discharge-starting voltage Vf2 between the scanning electrode and the sustain electrode.

$$Vst \leqq Vsh < Vf2$$

As a result, false discharge can be prevented. Therefore, even when a discharge-cell structure of a plasma display apparatus becomes high resolution, a stable image can be displayed.

Figure 4:
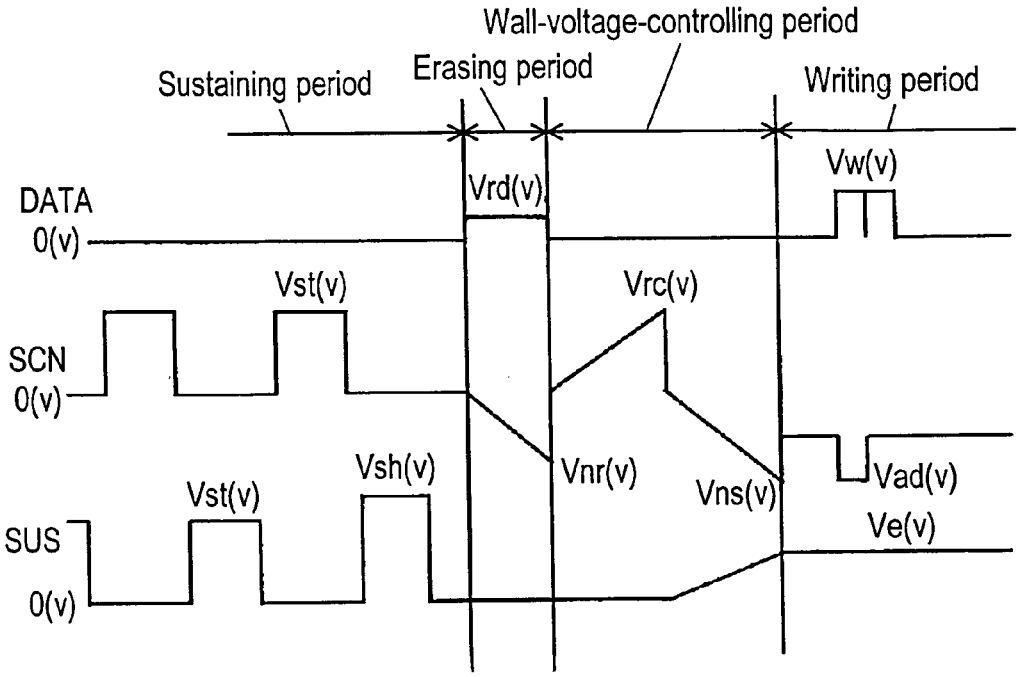
FIG. 4 shows a timing chart of a driving voltage supplied from the driver of the plasma display apparatus in accordance with the second exemplary embodiment of the present invention.

In addition, as shown in FIG. 4, the waveform of the driving voltage in the erasing period, which is described in the first embodiment, is preferably added to the waveform of the driving voltage in the second embodiment. The erasing period is a period for erasing unnecessary negative electric charge left near inter pixel gap IPG. Using the waveform discussed above, unnecessary negative electric charge can be erased more effectively.

Besides, peak voltage Vsh of the last pulse of the sustaining pulse preferably has the following relation for discharge-starting voltage Vf2 between the data electrode and the scanning electrode.

$$Vst \leqq Vsh < Vf2$$

More preferably, if peak voltage Vsh has the following relation, this invention becomes more effective.

$$(Vf2-50) \leqq Vsh < (Vf2-30) \quad \text{(V of units)}$$

THIRD EMBODIMENT

The third exemplary embodiment is described hereinafter with reference to the accompanying drawings. A panel section of the third embodiment is the same as that shown in FIG. 8. Besides, a schematic view of a driver, which outputs a driving voltage for driving the panel section, and a wire connecting state for electrodes of the panel section are the same as that shown in FIG. 9. Therefore, the descriptions of those elements are omitted here, and the only different points of the third embodiment are described hereinafter with reference to FIG. 5.

Figure 5:
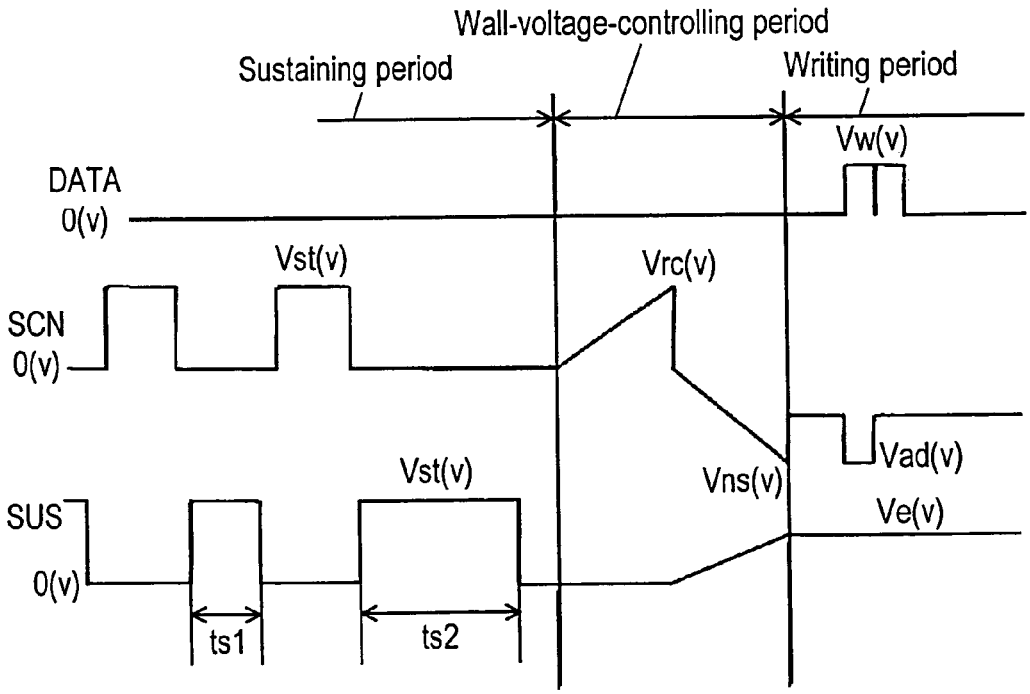
FIG. 5 shows a timing chart of a driving voltage supplied from a driver of a plasma display apparatus in accordance with a third exemplary embodiment of the present invention.

FIG. 5 shows a waveform of a driving voltage supplied from the driver for driving the panel section of a plasma display apparatus in the third embodiment. A sustaining period, a wall-voltage-controlling period and a writing period are shown in FIG. 5. In the third embodiment, pulse width ts2 of the last pulse of the sustaining pulse in the sustaining period is wider than pulse width ts1 of the sustaining pulse before the last pulse.

The effect of this relation is considered as follows. Pulse width ts2 of the last pulse of the sustaining pulse is wider than pulse width ts1 of the sustaining pulse before the last pulse, so that time when positive ions can move becomes longer in the last sustaining-discharge of the sustaining period. Therefore, positive ions can reach an outside of scanning electrode SCNi, i.e., near inter pixel gap IPG, where a long moving distance is required for positive ions. As a result, a wall voltage of a surface of protective film 5 on scanning electrode SCNi sufficiently changes from negative to positive. Thus, unnecessary negative electric charge does not remain, and false discharge is not generated.

As discussed above, pulse width ts2 of the last pulse of the sustaining pulse is wider than pulse width ts1 of the sustaining pulse before the last pulse, so that false discharge can be prevented. Therefore, even when a discharge-cell structure of a plasma display apparatus becomes high resolution, a stable image can be displayed.

Figure 6:
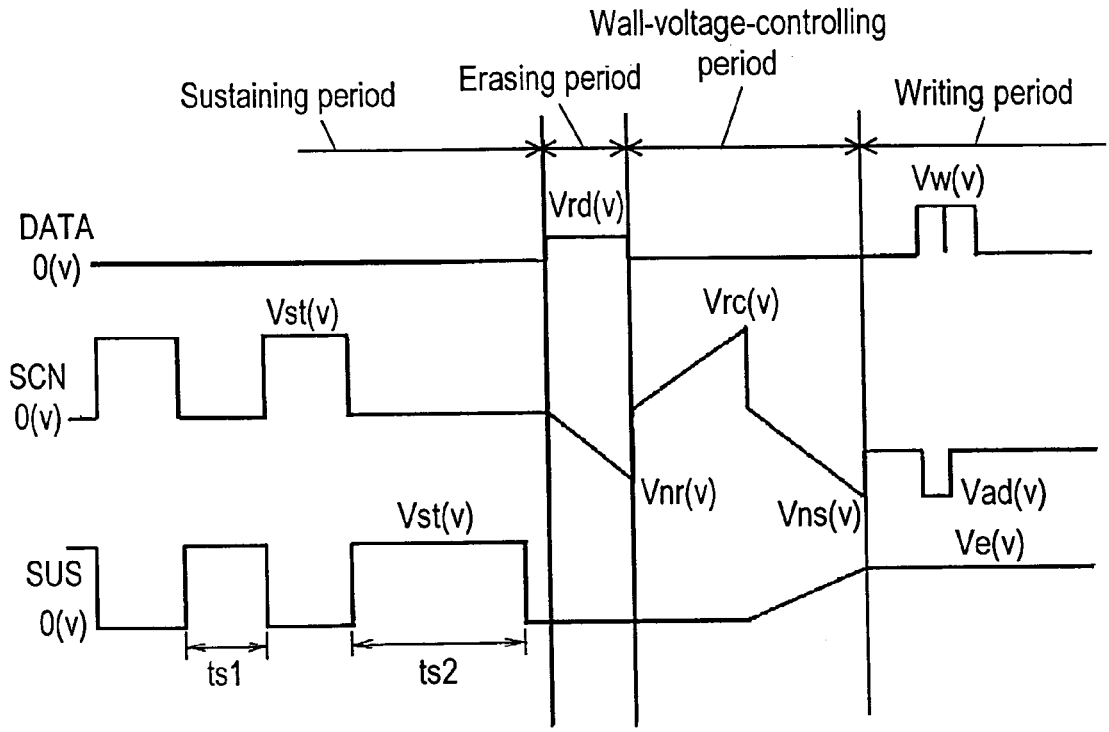
FIG. 6 shows a timing chart of a driving voltage supplied from the driver of the plasma display apparatus in accordance with the third exemplary embodiment of the present invention.

In addition, as shown in FIG. 6, the waveform of the driving voltage in the erasing period, which is described in the first embodiment, is preferably added to the waveform of the driving voltage in the third embodiment. The erasing period is a period for erasing unnecessary negative electric charge left near inter pixel gap IPG. Using the waveform discussed above, unnecessary negative electric charge can be erased more effectively.

Besides, when pulse width ts2 of the last pulse of the sustaining pulse in the sustaining period has the following relation for pulse width ts1 of the sustaining pulse before the last pulse, this invention becomes more effective.

$$(ts1+2) \leqq ts2 \leqq 20 \quad \text{(μs of units)}$$

In this embodiment, the pulse width of the last pulse of the sustaining pulse in the sustaining period is wider than the pulse width of another sustaining pulse before the last pulse of the sustaining pulse. However, this invention is not limited to this embodiment. For example, the pulse width of the second last pulse of the sustaining pulse or the pulse width of the third last pulse of the sustaining pulse can be wider than the pulse width of another sustaining pulse before the second or third last pulse of the sustaining pulse. Using these methods mentioned above, almost the same effect can be obtained.

Besides, in the first to third embodiments, the maximum voltage Vrc of the ramp voltage pulse, which is applied to the scanning electrode in the wall-voltage-controlling period, preferably has the following relation for discharge-starting voltage Vf1 between data electrode Dj and scanning electrode SCNi.

$$(Vf1-50) \leqq Vrc < Vf1 \quad \text{(V of units)}$$

In the first to third embodiments, rapid changing of voltages is required, however, in addition, slow changing in a manner to prevent unnecessary discharge from being generated is also required. Therefore, a slope of the ramp voltage pulse in the erasing period and the wall-voltage-controlling period preferably ranges from 0.5 V/μs to 20 V/μs.

As discussed above, in the panel section, scanning electrodes SCN1–SCNn are identical with sustain electrodes SUS1–SUSn, and they are distinguished by a driving voltage. Therefore, even when waveforms applied to scanning electrodes SCN1–SCNn and waveforms applied to sustain electrodes SUS1–SUSn are exchanged, the same effect can be obtained.

In this invention, during the initializing period, voltages of all sustain electrodes SUS1–SUSn increase rapidly from 0 to Vpu, where Vpu is a voltage not more than the discharge-starting voltage for all scanning electrodes SCN1–SCNn. Then, the driving voltage, which has a positive polarity and slowly increases from Vpu to Vru, is applied to all sustain electrodes SUS1–SUSn, where Vru is a voltage more than the discharge-starting voltage. However, as shown in FIG. 7, a rectangular pulse of voltage Vru can be applied to sustain electrodes SUS1–SUSn from the beginning, where Vru is a voltage more than the discharge-starting voltage.

As discussed above, the plasma display apparatus of this invention has the waveform of the driving voltage supplied from the driver. The waveform has the erasing period when the ramp voltage pulse whose polarity differs from that of the sustaining pulse is applied to the electrode, which differs from the electrode where the last pulse of the sustaining pulse is applied. As a result, unnecessary negative electric charge, which causes false discharge, left near the inter pixel gap IPG is erased, thereby preventing false discharge. Therefore, even when a discharge-cell structure of a plasma display apparatus becomes high resolution, a stable image can be displayed.

The invention claimed is:

1. A plasma display apparatus including:

(A) a panel section including:

(A-1) a first board having a plurality of scanning electrodes and sustain electrodes in pairs; and (A-2) a second board having data electrodes which cross the scanning electrodes and the sustain electrodes, and faced the first board; and (B) a driver for outputting a driving voltage for driving the panel section, the plasma display apparatus comprising:

a sustaining period when a sustaining pulse is alternately applied to the scanning electrodes and the sustain electrodes for keeping discharge, wherein a voltage Vsh of a last pulse of the sustaining pulse has a following relation for a voltage Vst of the sustaining pulse before the last pulse and a discharge-starting voltage Vf2 between one of the scanning electrodes and one of the sustain electrodes $$Vst \leqq Vsh < Vf2.$$

2. The plasma display apparatus of claim 1, wherein the voltage Vsh of the last pulse of the sustaining pulse has a following relation for the discharge-starting voltage Vf2 between the scanning electrode and the sustain electrode.

$$(Vf2-50) \leqq Vsh < (Vf2-30) \quad \text{(V of units).}$$

3. The plasma display apparatus of claim 1 further comprising:

an erasing period after the sustaining period, wherein the erasing period is a period when a ramp voltage pulse whose polarity differs from polarity of the last pulse of the sustaining pulse in the sustaining period is applied to an electrode, which differs from an electrode where the last pulse of the sustaining pulse is applied.

4. The plasma display apparatus of claim 1 further comprising:

an erasing period when a ramp voltage pulse whose polarity differs from polarity of the sustaining pulse is applied to an electrode, which differs from an electrode where the last pulse of the sustaining pulse is applied, wherein a slope of the ramp voltage pulse in the erasing period ranges from 0.5 V/μs to 20 V/μs.

5. A plasma display apparatus including:

(A) a panel section including:

(A-1) a first board having a plurality of scanning electrodes and sustain electrodes in pairs; and (A-2) a second board having data electrodes which cross the scanning electrodes and the sustain electrodes, and faced the first board; and (B) a driver for outputting a driving voltage for driving the panel section, the plasma display apparatus comprising:

a sustaining period when a sustaining pulse is alternately applied to the scanning electrodes and the sustain electrodes for keeping discharge, wherein a pulse width ts2 of a last pulse of the sustaining pulse is wider than a pulse width ts1 of the sustaining pulse before the last pulse.

6. The plasma display apparatus of claim 5, wherein the pulse width ts2 of the last pulse of the sustaining pulse has a following relation for the pulse width ts1 of the sustaining pulse before the last pulse.

$$(ts1+2) \leqq ts2 \leqq 20 \quad \text{(μs of units).}$$

7. The plasma display apparatus of claim 5 further comprising:

an erasing period after the sustaining period, wherein the erasing period is a period when a ramp voltage pulse whose polarity differs from polarity of the last pulse of the sustaining pulse in the sustaining period is applied to an electrode, which differs from an electrode where the last pulse of the sustaining pulse is applied.

8. The plasma display apparatus of claim 5 further comprising:

an erasing period when a ramp voltage pulse whose polarity differs from polarity of the sustaining pulse is applied to an electrode, which differs from an electrode where the last pulse of the sustaining pulse is applied, wherein a slope of the ramp voltage pulse in the erasing period ranges from 0.5 V/μs to 20 V/μs.

9. A plasma display apparatus including:

(A) a panel section including:

(A-1) a first board having a plurality of scanning electrodes and sustain electrodes in pairs; and (A-2) a second board having data electrodes which cross the scanning electrodes and the sustain electrodes, and faced the first board; and (B) a driver for outputting a driving voltage for driving the panel section, the plasma display apparatus comprising:

(a) a sustaining period when a sustaining pulse is alternately applied to the scanning electrodes and the sustain electrodes for keeping discharge; and (b) an erasing period when a ramp voltage pulse whose polarity differs from polarity of the sustaining pulse is applied to one of said scanning or sustain electrodes, which differs from another of said scanning or sustain electrodes where a last pulse of the sustaining pulse is applied.

10. The plasma display apparatus of claim 9, wherein the last pulse of the sustaining pulse is positive, and a minimum voltage Vnr of the ramp voltage pulse, which is applied in the erasing period, has a following relation for a discharge-starting voltage Vf1 between an electrode where the ramp voltage pulse is applied and one of the data electrodes.

$$-(Vf1-60) \leqq Vnr \leqq -30 \quad \text{(V of units).}$$

11. The plasma display apparatus of claim 9, wherein a slope of the ramp voltage pulse in the erasing period ranges from 0.5 V/μs to 20 V/μs.

* * * * *